US006128781A

United States Patent [19]

Spindler

[11] Patent Number: 6,128,781

[45] Date of Patent: Oct. 10, 2000

[54] TRAY AND BID FOOD CATCHING APPARATUS

[75] Inventor: Stephen E. Spindler, Stuart, Fla.

[73] Assignee: A. James Valliere and Stephen Spindler, Stuart, Fla.

[21] Appl. No.: 09/256,341

[22] Filed: Feb. 22, 1999

[51] Int. Cl.[7] ..... A41B 13/00

[52] U.S. Cl. ..... 2/49.3

[58] Field of Search ..... 2/48, 49.1, 49.2, 2/49.3, 50, 52

[56] References Cited

U.S. PATENT DOCUMENTS

| | | | |
|---|---|---|---|
| 114,366 | 5/1871 | Thomson . | |
| 453,490 | 6/1891 | Kropp . | |
| 590,991 | 10/1897 | Lenhart . | |
| 615,293 | 12/1898 | Maier . | |
| 899,853 | 9/1908 | Willard . | |
| 996,084 | 6/1911 | Herring . | |
| 1,108,557 | 8/1914 | Dudley . | |
| 2,265,690 | 12/1941 | Fiedler . | |
| 2,451,038 | 10/1948 | Mink . | |
| 2,532,932 | 12/1950 | Neiswander . | |
| 2,672,614 | 3/1954 | Zimmerman et al. . | |
| 2,688,750 | 9/1954 | Mink . | |
| 2,738,511 | 3/1956 | Brady . | |
| 2,905,943 | 9/1959 | Carlisle et al. . | |
| 4,114,199 | 9/1978 | Malan | 2/49.3 |
| 4,660,224 | 4/1987 | Ashcraft | 2/48 |
| 4,860,381 | 8/1989 | Bartley | 2/49.3 |
| 5,062,558 | 11/1991 | Stang | 224/270 |
| 5,107,545 | 4/1992 | Potter | 2/46 |
| 5,285,940 | 2/1994 | Goulter . | |
| 5,642,674 | 7/1997 | Joye, Sr. et al. | 108/43 |
| 5,915,530 | 6/1999 | Hager . | |

*Primary Examiner*—John J. Calvert
*Assistant Examiner*—Shirra L. Jenkins
*Attorney, Agent, or Firm*—A. James Valliere

[57] ABSTRACT

A tray and bib food catching apparatus for use in child feeding or the feeding of individuals where spilled food may be likely. The tray and bib food catching device allows food, including liquids, to be captured and retained in a pocket formed by the bib when used in conjunction with a tray. In one embodiment, the tray and the bib are integrally formed. The bib has an opening for the neck of the child or other user and has two arm openings. The arm openings are located closer to the tray than the neck opening such that when the bib is placed over the head and arms of a user, the upper arms and shoulder tend to support the fabric of the bib in an elevated position at the sides and allow the bib to sag into a pocket-like formation at the center immediately below the neck opening. The tray may also be made of a rigid material and be generally U-shaped at the edge facing the user.

6 Claims, 3 Drawing Sheets

TRAY AND BID FOOD CATCHING APPARATUS

BACKGROUND OF THE INVENTION

The present invention relates to devices particularly for use in child feeding, although they may be used for feeding other individuals where the spilling of food is highly likely.

The spilling of food in the feeding of small children is a commonplace occurrence. The training of children to eat in a manner consistent with normal adult eating styles can be an exasperating experience and can require months and even years of clean up of significant spilled food and liquids, making the aftermath of a child's eating experience unpleasant and time consuming. Many devices, including bibs, have been styled to minimize the clean up required after child feeding, attesting to the desirability of overcoming this problem. The present invention effectively solves this problem, making the clean up experience relatively effortless.

A foldable lap tray is illustrated in U.S. Pat. No. 5,671,479 and provides for a single device to cover part of the chest and lap of a user. However, this device does not deal with and is not capable of solving the above-mentioned problem in connection with the spilling of food and liquids in the training of children or other users who are incapable of managing the eating experience in a normal adult fashion.

A bib-bowl arrangement is shown in U.S. Pat. No. 4,860,381, which attempts to solve this problem by suggesting a bib which is contoured to allow food spillage to slide back into a user bowl. Unfortunately, this allows the backwashed and spilled food to go back into the bowl to be re-eaten and does not provide a means for separately capturing and segregating the waste food from the food being fed to the child.

A further bib-tray structure for use during infant feeding is illustrated in U.S. Pat. No. 4,114,199. This device is an integral bib and tray arrangement but does not provide any means for catching spilled food independently of the tray. In this device, much of the spilled food falls back into the tray, resulting in an unpalatable situation.

Other similar arrangements are disclosed in U.S. Pat. No. 1,108,557, as well as U.S. Pat. Nos. 5,062,558, and, 5,642,674.

SUMMARY OF THE INVENTION

According to the invention, a tray and bib food catching apparatus comprises a bib which fits around the head of the user and arm openings positioned adjacent to the head opening and located such that the entire arms up to the shoulder fits through the openings. The arm openings are located forwardly of the neck opening and the lower end of the bib is removably attached to the tray. Since the arm openings are closer to the lower edge of the bib, the shoulders of the user tend to elevate the bib material in the vicinity of the arms relative to the central portion of the bib, thereby creating a pocket between the user and the tray. This elevating of the bib fabric by the shoulders tends to produce a damming effect at both ends of the pocket to prevent spilled food from flowing sideways out of the pocket. In another embodiment of the invention, the bib and tray are integrally formed of a flexible sheet of material, however, the same type of pocket with side damming is created.

Accordingly, it is an object of the invention to provide a bib and tray arrangement whereby spilled food can be trapped between the user and the tray and not interfere with the cleanliness of the tray or the user during feeding of the user.

It is another object of the invention to provide a combination of the rigid tray and a flexible bib which can be readily detachably connected to the tray in such a way as to form a food catching pocket between the user and the tray.

DESCRIPTION OF THE PREFERRED EMBODIMENT

The present invention relates to a bib and tray apparatus which effectively allows spilled food, including liquids to be captured in a pocket located between the user and the tray. The pocket is sufficiently large to support considerable quantities of spilled food and liquid and is designed so that liquids do not flow out of the pocket onto the floor.

Figure 1:
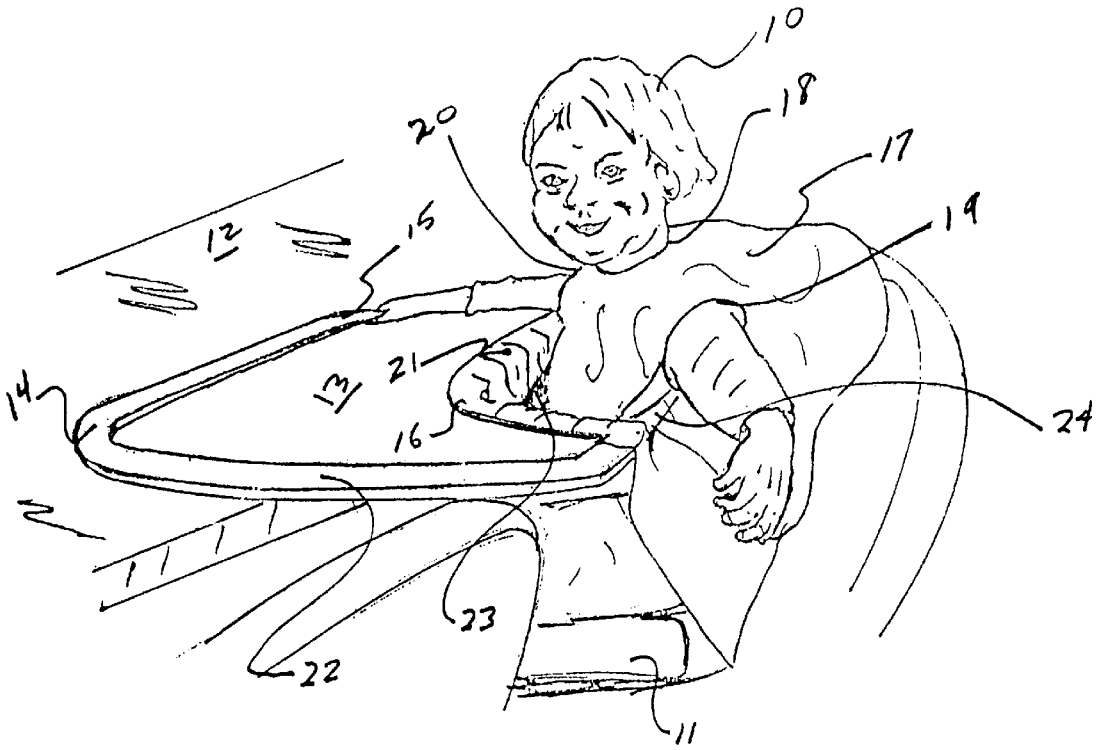
FIG. 1 is an illustration of a child sitting at a table utilizing a flexible bib and rigid tray apparatus of the invention.

An apparatus according to the present invention is demonstrated by the sketch in FIG. 1 in which a child 10 is seated on a seat 11 and positioned at a horizontal surface or table 12. A tray 13 rests on the surface of the table 12 and may be held in place by adhesive means such as suction cups or other means located at the bottom of the tray at, for example, locations 14 and 15. This holds the tray in place against any normal force applied to the tray by the child.

As shown in FIG. 1, the tray has a contoured edge 16 facing the child. The child is wearing a bib 17 which has an upper portion thereof which has a neck opening 18 and first and second bib supporting means comprising arm openings 19 and 20. The bottom edge of the bib 21 is turned up to overlie a rim 22 of the tray 13. The end of the bib 21 is held in place by a continuous length of a hook and loop fastener (Velcro) or other suitable adhesive material.

The bib 17 has a lower food catching portion which forms a food catching channel 23 between the child and the tray. This channel is confined or dammed at both ends by portions of fabric 24 which, by virtue of the design of this invention, is maintained in an elevated position with respect to the bottom of the food catching channel 23.

Figure 2:
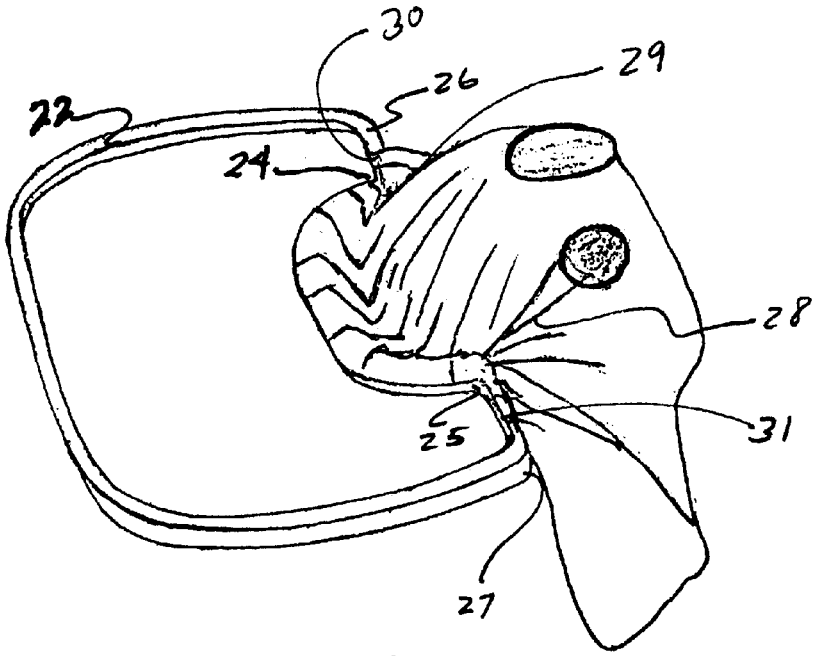
FIG. 2 is a perspective view of a rigid tray attached to a flexible bib illustrating in particular the formation of the food catching pocket of the present invention.

FIG. 2 shows more explicitly the design of the bib and tray arrangement to accomplish the goals of the present invention which is the provision of the food retaining pocket between the user and the tray and the effective damming of that pocket at both ends thereof. In FIG. 2, the bib 17 overlies a U-shaped configuration of the tray 13. The U-shaped configuration extends from point 24 to point 25. Regions 26 and 27 of the tray appear as extensions and are the ends of the U-shaped configuration. These ends serve two functions. One is to allow the user to rest his or her arms while eating and the other is to provide suitable attachment means for the flexible fabric of the bib 17 to cause a damming effect at both ends of the tray.

As shown in FIG. 2, the food catching channel 23 is deeper at the center of the U-shaped configuration and is dammed or blocked in the areas adjacent to points 24 and 25. Fabric 28 and similarly at 29, is bunched to provide the dam. This is a result of the fact that there is a shorter distance between the point of support of the fabric at the shoulder and the point of attachment to the tray than the distance from the point of support of the fabric at the neck and the point of attachment to the tray immediately below the neck.

The armholes 19 and 20 effectively keep the fabric sufficiently elevated to provide this damming effect which prevents spillage from the pocket 23 onto the floor.

As stated above, the flexible fabric of the bib may be secured to the U-shaped configuration of the tray by a hook and loop fastener (Velcro) extending along the entire length of the bottom edge of the bib from point 30 to point 31. Snaps can also be used in place of the a hook and loop fastener (Velcro) or other material which can be quickly and easily detached from the tray.

The tray 13 has a rim 22 around the entire periphery, and the attachment means, be it a hook and loop fastener (Velcro) or snaps, is supported at the top edge of the rim 22. This prevents food which is spilled onto the tray from easily soaking into the a hook and loop fastener (Velcro) or snaps, keeping them relatively protected.

In this embodiment, the tray 13 may be formed of a rigid material such as plastic or other nonabsorbent material and is held in place on a horizontal eating surface by suction cups at locations 14 and 15 as previously described. The bib 17 is formed of a suitable nonabsorbent flexible material. When the eating session is finished, the supervising person disconnects the a hook and loop fastener (Velcro) connection to the tray and lifts the bib 17 over the head and arms of the child while maintaining the food or spilled fluids in the pocket 23. The entire bib is then moved to the location of a sink where it may be emptied easily and quickly. Since the tray also is a retention system by virtue of the rim 22, it too can be easily detached from the table, moved to the sink and emptied with relative ease.

Figure 3:
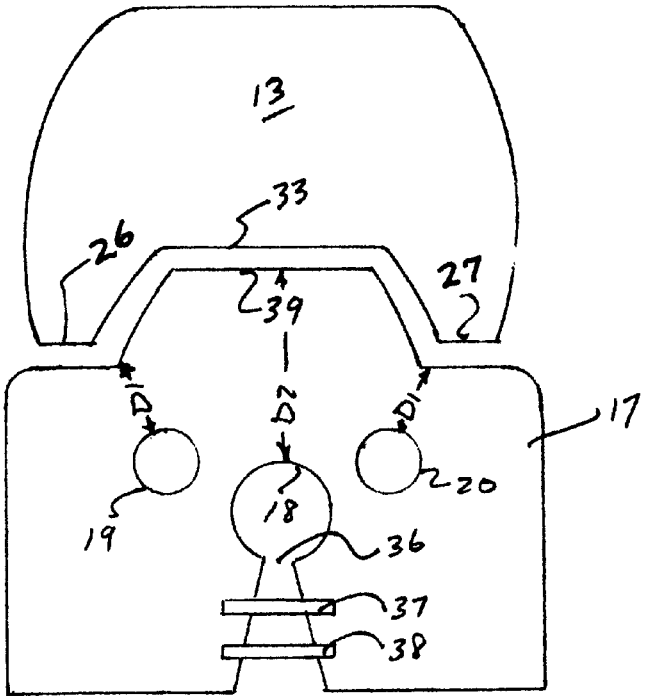
FIG. 3 is a top view of the flexible bib and rigid tray with the flexible bib lying in a plane to illustrate the U-shaped configuration of the tray and the matching portion of the bib.

The general configurations of the bib and tray are shown in FIG. 3. The outline of the tray 13 is configured to have a central segment 33 and extensions 26 and 27 to form a U-shaped configuration which is matched by a similar configuration of the bib 17.

As shown more clearly in FIG. 3, the neck opening 18 is opened at the rear 36 and may be held in position by suitable straps 37 and 38. The straps 37 and 38 may be hook and loop fastener or other adhesive material. The arm openings 19 and 20 are positioned relatively close to the neck opening 18, and they are located closer to the tray 13 than the neck portion 18. The bib has a portion intermediate of the neck portion 18 and the food catching channel 23 to overlie the chest of a user.

Since the shoulders of the user are adjacent to the openings 19 and 20, the short distance of the fabric D-1 is held in an elevated position with respect to the fabric at point 39 which is long enough from the neck opening 28 to sag into a pocket-like configuration in front of the user. Essentially, the distance D-2 being greater than D-1 allows the pocket to be formed and dammed at both sides so that spilled food, including liquids, will not flow out of the pocket sideways. It is also apparent from both FIGS. 3 and 4, a line intersecting both arm openings or armholes is closer to the tray than is the neck opening.

In another embodiment of the invention, the bib pocket material and tray are formed integrally of a single sheet of flexible nonabsorbent material. This embodiment is shown in FIG. 4.

Figure 4:
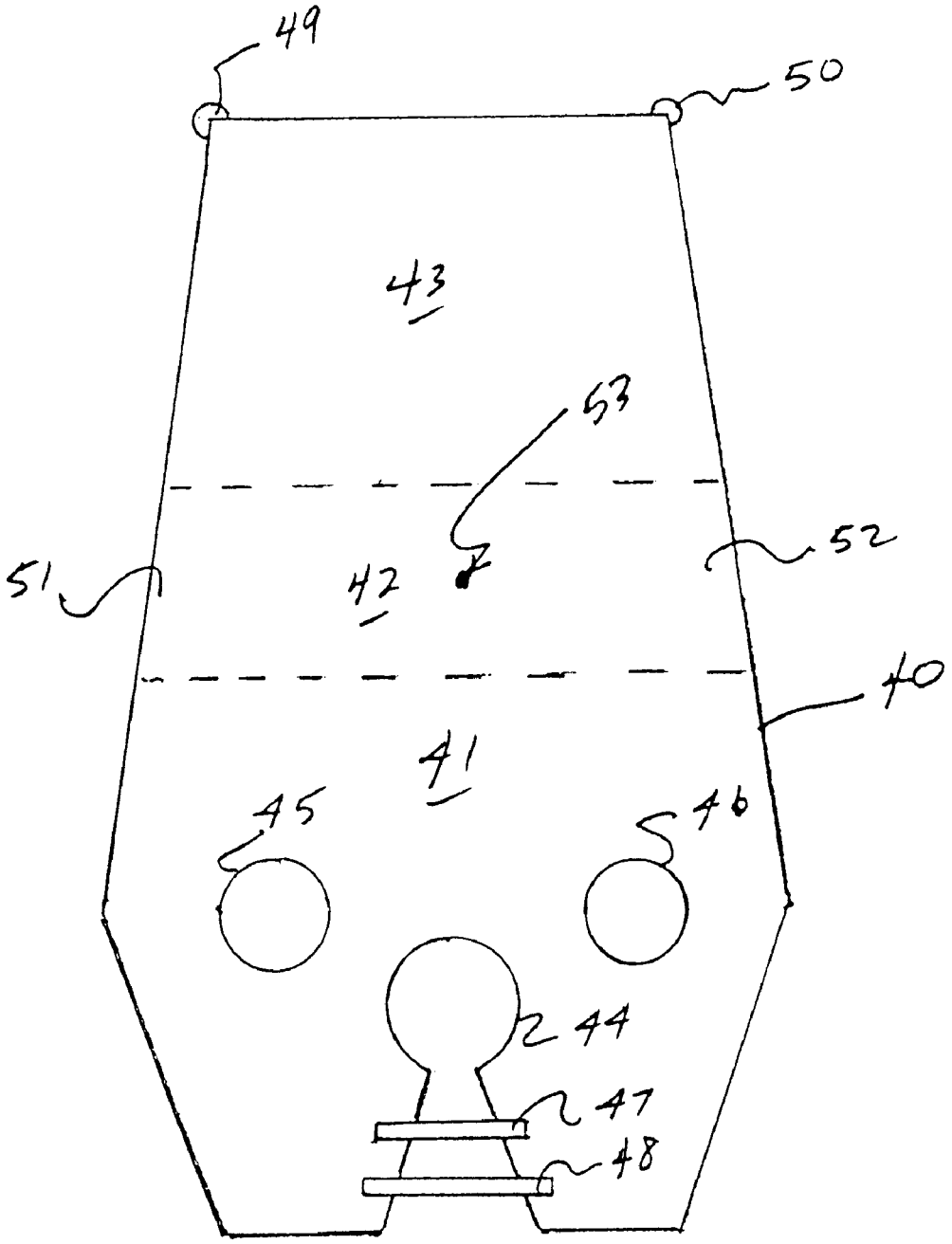
FIG. 4 is a top view of an integrally formed flexible bib, food catching pocket, and tray arrangement, illustrating the configuration of the flexible sheet when laid in a single plane.

In FIG. 4, a single sheet of material 40 consists of a bib portion 41, a central food catching pocket portion 42 and a tray portion 43. This device also has a neck opening 44 and arm openings 45 and 46. The neck opening 44 is similar to the arrangement shown in FIG. 3 and is held in place around the neck of the user by adhesive connecting straps 47 and 48. The sheet 40 has suction cups 49 and 50 at the extreme ends of the tray portion 43. Continuous adhesive material may also be used in place of the suction cups.

In use, the sheet 40 is placed around the neck of the user at 44, and the user's arms are extended through the openings 45 and 46. The suction cups 49 and 50 are positioned on a table or other eating surface in such a manner as to allow the portion 42 to sag between the table and the user to form a food catching pocket similar to the pocket 23 of FIGS. 1 and 2.

The pocket formed by the fabric at 42 is similarly dammed at both ends 51 and 52 due to the fact that the fabric at the outside edges of the sheet 40 is maintained in an elevated position by virtue of the arm openings 45 and 46. These arm openings, in effect, support the fabric in that region at approximate shoulder height, allowing the fabric in the area 53 to sag and form a pouch. Spilled food in the pouch at 53 will not run outwardly from the sides due to the damming effect as explained below.

While the arrangement shown in FIG. 4 does not have all the advantages of the rigid tray 13 as shown in FIGS. 1 and 2, it has the advantage that it can be made extremely economically and could, in the extreme example, be made to be disposable, which would add to the convenience of the clean up task.

I claim:

1. A tray and bib food catching apparatus comprising:

a tray having means for being positioned horizontally in front of a user;

a flexible bib having means at an upper portion thereof for being removably attached to the neck of a user, a lower food catching portion being attached to said tray during use, and an intermediate portion connecting the upper neck portion and said food catching portion to overly and protect the chest of a user;

the lower food catching portion of said flexible bib being of sufficient length to form a user depending food catching channel between said tray and a user;

said bib and tray in combination having damming means at both sides of said lower food catching portion of said flexible bib for preventing the sideways flow of food out from the user food catching channel;

said damming means including first and second means at the upper portion of said flexible bib located oppositely of said neck attachment means for supporting said bib from respective left and right shoulders of a user, and the shortest distance as measured along said flexible bib from a straight line intersecting said first and second means to said tray being less than the shortest distance as measured along said flexible bib from said neck attachment means to said tray.

2. A tray and bib food catching apparatus in accordance with claim 1 wherein:

said $1^{st}$ and $2^{nd}$ means comprises $1^{st}$ and $2^{nd}$ armholes in said flexible bib, said armholes being located substantially at neck to shoulder distance from said neck attachment means, whereby the insertion of the arms of a user into said armholes causes the portions of said bib located between the armholes and the tray to be maintained in an elevated position relative to the portions of said bib located between the neck attachment means and the tray, causing said food catching channel to be dammed at both sides thereof.

3. A tray and bib food catching apparatus in accordance with claim 1 wherein said tray and flexible bib are integrally formed of a sheet of flexible material, and wherein adhesive means are attached to the tray to secure the same to an exterior generally horizontal eating surface.

4. A tray and bib food catching apparatus comprising:

a generally U-shaped tray defining a U-shaped edge which, in use, faces and partially surrounds the user;

$1^{st}$ attachment means distributed along said U-shaped edge;

A flexible bib having a neck opening at its upper portion and means removably attaching the bib around the neck of a user;

said flexible bib having two arm openings positioned respectively at opposite sides of the neck opening at approximate neck to shoulder distance therefrom;

said flexible bib having a food catching portion extending downwardly a distance substantially in excess of the shoulder to lap dimension of a user and terminating in a $2^{nd}$ attachment means for being removably attached to the $1^{st}$ attachment means of said tray;

the distance, as measured along the flexible bib, between either of said arm openings and respective ends of the U of the U-shaped tray, in the attached mode, being substantially less than the distance, as measured along the flexible bib, between the neck opening and the base of the U, whereby, the attaching of the bib to a user at the neck and arm openings and to the tray via the $1^{st}$ and $2^{nd}$ attachment means is adapted to form a food catching pocket which is dammed at both ends thereof.

5. A tray and bib food catching apparatus in accordance with claim 4 wherein:

said tray has means for being quickly detachably secured to a generally horizontal surface.

6. A tray and bib food catching apparatus in accordance with claim 5 wherein:

said means for quickly detachably securing said tray to a generally horizontal surface includes suction cups mounted at the underside of said tray at a location which is spaced oppositionally from the U-shaped cavity thereof.

* * * * *